United States Patent [19]

Nair

[11] Patent Number: 4,652,397

[45] Date of Patent: Mar. 24, 1987

[54] RESISTOR COMPOSITIONS

[75] Inventor: Kumaran M. Nair, East Amherst, N.Y.

[73] Assignee: E. I. Du Pont de Nemours and Company, Wilmington, Del.

[21] Appl. No.: 682,298

[22] Filed: Dec. 17, 1984

[51] Int. Cl.[4] ..... H01B 1/06

[52] U.S. Cl. ..... 252/513; 252/518; 252/520; 252/521; 252/519; 338/308; 29/610 R; 428/551

[58] Field of Search ..... 252/518, 519, 520, 521, 252/513; 338/308; 29/610 R; 428/551

[56] References Cited

U.S. PATENT DOCUMENTS

| | | | |
|---|---|---|---|
| 3,394,087 | 7/1968 | Huang et al. | 252/512 |
| 3,503,801 | 3/1970 | Huang et al. | 117/221 |
| 4,039,997 | 8/1977 | Huang et al. | 338/308 |
| 4,107,387 | 8/1978 | Boonstra et al. | 428/426 |
| 4,137,519 | 1/1979 | Hodge | 338/308 |
| 4,168,344 | 9/1979 | Shapiro et al. | 428/427 |
| 4,205,298 | 5/1980 | Shapiro et al. | 338/308 |
| 4,209,764 | 6/1980 | Merz et al. | 338/308 |
| 4,215,020 | 7/1980 | Wahlers et al. | 252/519 |
| 4,333,861 | 6/1982 | Aoki et al. | 252/518 |
| 4,384,989 | 5/1983 | Kamigaito et al. | 252/516 |
| 4,548,741 | 10/1985 | Hormadaly | 252/518 |

FOREIGN PATENT DOCUMENTS

| | | |
|---|---|---|
| 0008437 | 3/1980 | European Pat. Off. . |
| 0071190 | 2/1983 | European Pat. Off. . |
| 0146120 | 6/1985 | European Pat. Off. . |
| 58-36481 | 8/1983 | Japan . |

*Primary Examiner*—Stephen J. Lechert, Jr.

[57] ABSTRACT

The invention is directed to a thick film resistor composition for firing in a low oxygen-containing atmosphere comprising finely divided particles of (a) semiconductive material consisting essentially of a cationic excess solid solution and (b) a nonreducing glass having a softening point below that of the semiconductive material dispersed in (c) organic medium and to resistor elements made therefrom.

7 Claims, No Drawings

RESISTOR COMPOSITIONS

FIELD OF INVENTION

The invention relates to thick film resistor compositions and especially those which are fireable in low oxygen-containing atmospheres.

BACKGROUND OF THE INVENTION

Screen printable resistor compositions compatible with nitrogen (or low oxygen partial pressure) fireable conductors are relatively new in the art of thick film technology.

Thick film resistor composites generally comprise a mixture of electrically conductive material finely dispersed in an insulative glassy phase matrix. Resistor composites are then terminated to a conductive film to permit the resultant resistor to be connected to an appropriate electrical circuit.

The conductive materials are usually sintered particles of noble metals. They have excellent electrical characteristics; however, they are expensive. Therefore, it would be desirable to develop circuits containing inexpensive conductive materials and compatible resistors having a range of stable resistance values.

In general, nonnoble metal conductive phases such as Cu, Ni, Al, etc. are prone to oxidation. During the thick film processing, they continue to oxidize and increase the resistance values. However, they are relatively stable if the processing can be carried out at low oxygen partial pressure or "inert" atmosphere. As used herein, low oxygen partial pressure is defined as the oxygen partial pressure that is lower than the equilibrium oxygen partial pressure of the system consisting of the metal conductive phase and its oxide at the firing temperature. Therefore, development of compatible resistor functional phases which are capable of withstanding firing in a low oxygen partial pressure without degradation of properties is the prime objective in this technology. The phases must be thermodynamically stable after the processing of the resistor film and noninteractive to the nonprecious metal terminations when they are cofired in an "inert" or low oxygen partial pressure atmosphere. The major stability factor is the temperature coefficient of resistance (TCR). The materials are considered stable when their resistance values do not change appreciably when the resistor components are subjected to temperature changes.

BRIEF DESCRIPTION OF THE INVENTION

In its primary aspect, the invention is directed to a thick film resistor composition for firing in a low oxygen-containing atmosphere comprising finely divided particles of (a) a semiconductive material consisting essentially of a cationic excess solid solution in metal oxide, of a metal (1) the oxide of which has a lower oxygen partial pressure at the firing temperature than the oxygen partial pressure of the atmosphere in which the composition is fired and (2) which has a free energy of formation more negative than copper; (b) a nonreducing glass having a softening point below that of the semiconductive material, dispersed in (c) organic medium.

In a second aspect, the invention is directed to a resistor element comprising a printed layer of the above-described composition which has been fired in a low oxygen-containing atmosphere to effect volatilization of the organic medium and liquid phase sintering of the glass.

PRIOR ART

Huang et al. in U.S. Pat. No. 3,394,087 discloses resistor composition comprising a mixture of 50–95% wt. vitreous glass frit and 50–5% wt. of a mixture of refractory metal nitride and refractory metal particles. Disclosed are nitrides of Ti, Zr, Hf, Va, Nb, Ta, Cr, Mo and W. The refractory metals include Ti, Zr, Hf, Va, Nb, Ta, Cr, Mo and W. U.S. Pat. No. 3,503,801 Huang et al. disclose a resistor composition comprising a vitreous glass frit and fine particles of Group IV, V or VI metal borides such as $CrB_2$, $ZrB_2$, $MoBr_2$, $TaB_2$ and $TiB_2$. In U.S. Pat. No. 4,039,997 to Huang et al. a resistor composition is disclosed comprising 25–90 wt. % borosilicate glass and 75–10 wt. % of a metal silicide. Disclosed metal silicides are $WSi_2$, $MoSi_2$, $VaSi_2$, $TiSi_2$, $ZrSi_2$, $CaSi_2$ and $TaSi_2$. Boonstra et al. in U.S. Pat. No. 4,107,387 disclose a resistor composition comprising a metal rhodate ($Pb_3Rh_7O_{15}$ or $Sr_3RhO_{15}$), glass binder and a metal oxide TCR driver. The metal oxide corresponds to the formula $Pb_2M_2O_{6-7}$, wherein M is Ru, Os or Ir. Hodge in U.S. Pat. No. 4,137,519 discloses a resistor composition comprising a mixture of finely divided particles of glass frit and $W_2C_3$ and $WO_3$ with or without W metal. Shapiro et al. in U.S. Pat. No. 4,168,344 disclose resistor compositions comprising a mixture of finely divided particles of glass frit and 20–60% wt. Ni, Fi and Co in the respective proportions of 12-75/5-60/5-70% vol. Upon firing, the metals form an alloy dispersed in the glass. Again, in U.S. Pat. No. 4,205,298, Shapiro et al. disclose resistor compositions comprising a mixture of vitreous glass frit having fine particles of $Ta_2N$ dispersed therein. Optionally the composition may also contain fine particles of B, Ta, Si, $ZrO_2$ and $MgZrO_3$. Merz et al. in U.S. Pat. No. 4,209,764 disclose a resistor composition comprising a mixture of finely divided particles of vitreous glass frit, Ta metal and up to 50% wt. Ti, B, $Ta_2O_5$, $TiO_2$, $BaO_2$, $ZrO_2$, $WO_3$, $Ta_2N$, $MoSi_2$ or $MgSiO_3$. In U.S. Pat. No. 4,215,020, to Wahlers et al. a resistor composition is disclosed comprising a mixture of finely divided particles of $SnO_2$, a primary additive of oxides of Mn, Ni, Co or Zn and a secondary additive of oxides of Ta, Nb, W or Ni. The Kamigaito et al. patent, U.S. Pat. No. 4,384,989, is directed to a conductive ceramic composition comprising $BaTiO_3$, a doping element such as Sb, Ta or Bi and an additive, such as silicon nitride, titanium nitride, zirconium nitride or silicon carbide, to lower the resistivity of the composition. Japanese patent application 58-36481 to Hattori et al. is directed to a resistor composition comprising $Ni_xSi_y$ or $Ta_xSi_y$ and any glass frit (". . . there is no specification regarding its composition or method of preparation.").

DETAILED DESCRIPTION OF THE INVENTION

The compositions of the invention are directed to heterogeneous thick film compositions which are suitable for forming microcircuit resistor components which are to undergo firing in a low oxygen-containing atmosphere. As mentioned above, the low oxygen atmosphere firing is necessitated by the tendency of base metal conductive materials to be oxidized upon firing in air. The resistor compositions of the invention therefore contain the following three basic components: (1) one or more semiconductive materials which are cation rich solid solutions: (2) one or more metallic conductive materials or precursors thereof; (3) an insulative glass binder, all of which are dispersed in (4) an organic medium.

The resistance values of the composition are adjusted by changing the relative proportions of the semiconductive/conductive/insulative phases present in the system. Supplemental inorganic materials may be added to adjust the temperature coefficient of resistance. After printing over alumina or similar ceramic substrates and firing in low oxygen partial pressure atmosphere, the resistor films provide a wide range of resistance values and low temperature coefficient of resistance depending on the ratio of the functional phases.

A. Semiconductive Material

The semiconductive materials which may be used in the compositions of the invention are cationic excess (doped) solid solutions of the type $Me:Me'O_x$ in which Me and Me' can be either the same or different metals.

When Me and Me' are different, it is essential that Me be compatible with the Me'O crystal lattice. That is, the charge (valence), ionic radius, chemical affinity and crystallographic structure of Me and Me' must be comparable to each other; they must not be very different. Meeting these criteria are, among others, $Sn:SnO_2$, $Sb:SnO_2$, $In:SnO_2$, $Zr:ZrO_2$, $Hf:HfO_2$, and $Zr:HfO_2$. The above-described metal-metal oxide solid solutions are metal rich solutions in which the metal oxide lattice contains an excess of metal cations. Within the mutual solubility limits of the components, the concentration of Me to $Me'O_x$ can be changed to vary the semiconductive properties of the system. Typically, the solution will contain on the order of 0.01 to 15 atom % of the metal component. Doping of metal oxide ($Me'O_x$) with $Me^{2+}$ or $Me^{3+}$ oxides leads to the formation of lattice and electronic defects in order to maintain charge neutrality of the material. These defects are partially responsible for the specific electrical properties of these solid solutions. More detailed treatment of this subject is given in Z. M. Jarzebski, *Oxides Semiconductors,* Pergamon Press, NY 1973.

As indicated above, it is also essential that the oxide of the dissolved metal (Me) have a lower oxygen partial pressure at the firing temperature of the resistor than the oxygen partial pressure of the atmosphere in which the composition is fired. If that condition is not met, the resultant resistor will be unstable with respect to its electrical properties. In this regard, reference is made to FIG. 7.7 of R. A. Swalin, *Thermodynamics of Solids,* John Wiley & Sons, Inc. NY, 1962. This figure is a plot of the standard free energy of formation of various oxides as a function of temperature and also shows the oxygen partial pressure of many such oxides.

Furthermore, it is essential that the metallic content of the solid solution have a free energy of formation below that of copper in order to prevent chemical reactions with copper and other base metal conductive materials which may be used in the termination of these resistors.

B. Glass Binder

The third major component present in the invention is one or more of insulative phases. The glass frit can be of any composition which has a melting temperature below that of the semiconductive and/or conductive phases and which contains nonreducible inorganic ions or inorganic ions reducible in a controlled manner. Preferred compositions are alumino borosilicate glass containing $Ba^{2+}$, $Ca^{2+}$, $Zn^{2+}$, $Na^{+}$ and $Zr^{4+}$; alumino borosilicate glass containing $Pb^{2+}$ and $Bi^{3+}$, and alumino borosilicate glass containing $Ca^{2+}$, $Zr^{4+}$ and $Ti^{4+}$ and lead germanate glass, etc. Mixtures of these glasses can also be used.

During the firing of the thick film in a reducing atmosphere, inorganic ions reduce to metals and disperse throughout the system and become a conductive functional phase. Examples for such a system are glasses containing metal oxides such as ZnO, SnO, $SnO_2$, etc. These inorganic oxides are nonreducible thermodynamically in the nitrogen atmosphere. However, when the "border line" oxides are buried or surrounded by carbon or organics, the local reducing atmosphere developed during firing is far below the oxygen partial pressure of the system. The reduced metal is either evaporated and redeposited or finely dispersed within the system. Since these fine metal powders are very active, they interact with or diffuse into other oxides and form metal rich phases.

The glasses are prepared by conventional glass making techniques, by mixing the desired components in the desired proportions and heating the mixture to form a melt. As is well known in the art, heating is conducted to a peak temperature and for a time such that the melt becomes entirely liquid and homogeneous. In the present work the components are premixed by shaking in a polyethylene jar with plastic balls and then melted in a crucible at up to 1200° C., depending on the composition of the glass. The melt is heated at a peak temperature for a period of 1–3 hours. The melt is then poured into cold water. The maximum temperature of the water during quenching is kept as low as possible by increasing the volume of water to melt ratio. The crude frit after separation from water is freed of residual water by drying in air or by displacing the water by rinsing with methanol. The crude frit is then ball-milled for 3–5 hours in porcelain containers using alumina balls. The slurry is dried and Y-milled for another 24–48 hours depending on the desired particle size and particle size distribution in polyethylene lined metal jars using alumina cylinders. Alumina picked up by the materials, if any, is not within the observable limit as measured by X-ray diffraction analysis.

After discharging the milled frit slurry from the mill, the excess solvent is removed by decantation and the frit powder is then screened through a 325 mesh screen at the end of each milling process to remove any large particles.

The major properties of the frit are: it aids the liquid phase sintering of the inorganic crystalline particulate matters; some inorganic ions present in the frit reduce to conductive metal particles during the firing at the reduced oxygen partial pressure; and part of the glass frit form the insensitive functional phase of the resistor.

C. Conductive Material

Because the semiconductive resistor materials generally have quite high resistivities and/or highly negative HTCR (Hot Temperature Coefficient of Resistance) values, it will normally be preferred to include a conductive material in the composition. Addition of the conductive materials increases conductivity; that is, lowers resistivity and in some instances may change the HTCR value as well. However, when lower HTCR values are needed, various TCR drivers may be used. Preferred conductive materials for use in the invention are $RuO_2$, Ru, Cu, Ni, and $Ni_3B$. Other compounds which are precursors of the metals under low oxygen containing firing conditions can also be used. Alloys of the metals are useful as well.

ORGANIC MEDIUM

The above-described inorganic particles are mixed with an inert liquid medium (vehicle) by mechanical mixing (e.g., on a roll mill) to form a pastelike composition having suitable consistency and rheology for screen printing. The latter is printed as a "thick film" on conventional ceramic substrates in the conventional manner.

The main purpose of the organic medium is to serve as a vehicle for dispersion of the finely divided solids of the composition in such form that it can readily be applied to ceramic or other substrates. Thus, the organic medium must first of all be one in which the solids are dispersible with an adequate degree of stability. Secondly, the rheological properties of the organic medium must be such that they lend good application properties to the dispersion.

Most thick film compositions are applied to a substrate by means of screen printing. Therefore, they must have appropriate viscosity so that they can be passed through the screen readily. In addition, they should be thixotropic in order that they set up rapidly after being screened, thereby giving good resolution. While the rheological properties are of primary importance, the organic medium is preferably formulated also to give appropriate wettability of the solids and the substrate, good drying rate, dried film strength sufficient to withstand rough handling, and good firing properties. Satisfactory appearance of the fired composition is also important.

In view of all these criteria, a wide variety of liquids can be used as organic medium. The organic medium for most thick film compositions is typically a solution of resin in a solvent frequently also containing thixotropic agents and wetting agents. The solvent usually boils within the range of 130°-350° C.

By far, the most frequently used resin for this purpose is ethyl cellulose. However, resins such as ethylhydroxyethyl cellulose, wood rosin, mixtures of ethyl cellulose and phenolic resins, polymethacrylates of lower alcohols, and monobutyl ether of ethylene glycol monoacetate can also be used.

Suitable solvents include kerosene, mineral spirits, dibutylphthalate, butyl Carbitol, butyl Carbitol acetate, hexylene glycol, and high-boiling alcohols and alcohol esters. Various combinations of these and other solvents are formulated to obtain the desired viscosity and volatility.

Among the thixotropic agents which are commonly used are hydrogenated castor oil and derivatives thereof and ethyl cellulose. It is, of course, not always necessary to incorporate a thixotropic agent since the solvent/resin properties coupled with the shear thinning inherent in any suspension may alone be suitable in this regard. Suitable wetting agents include phosphate esters and soya lecithin.

The ratio of organic medium to solids in the paste dispersions can vary considerably and depends upon the manner in which the dispersion is to be applied and the kind of organic medium used. Normally, to achieve good coverage, the dispersions will contain complementally by weight 40–90% solids and 60–10% organic medium.

The pastes are conveniently prepared on a three-roll mill. The viscosity of the pastes is typically 20–150 Pa.s when measured at room temperature on Brookfield viscometers at low, moderate and high shear rates. The amount and type of organic medium (vehicle) utilized is determined mainly by the final desired formulation viscosity and print thickness.

FORMULATION AND APPLICATION

The resistor material of the invention can be made by thoroughly mixing together the glass frit, conductive phases and semiconductive phases in the appropriate proportions. The mixing is preferably carried out by either ball milling or ball milling followed by Y-milling the ingredients in water (or an organic liquid medium) and drying the slurry at 120° C. overnight. In certain cases, the mixing is followed by calcination of the material at a higher temperature, preferably at up to 500° C., depending on the composition of the mixture. The calcined materials are then milled to 0.5–2$\mu$ or less average particle size. Such a heat treatment can be carried out either with a mixture of conductive and semiconductive phases and then mixed with appropriate amount of glass or semiconductive and insulative phases and then mixed with conductive phases or with a mixture of all functional phases. Heat treatment of the phases generally improves the control of TCR. The selection of calcination temperature depends on the melting temperature of the particular glass frit used.

To terminate the resistor composition onto a substrate, the termination material is applied first to the surface of a substrate. The substrate is generally a body of sintered ceramic material such as glass, porcelain, steatite, barium titanate, alumina or the like. A substrate of Alsimag® alumina is preferred. The termination material is then dried to remove the organic vehicle and fired in a conventional furnace or a conveyor belt furnace in an inert atmosphere, preferably $N_2$ atmosphere. The maximum firing temperature depends on the softening point of the glass frit used in the termination composition. Usually this temperature varies between 750° C. to 1200° C. When the material cooled to room temperature, there is formed a composite of glass having particles of conductive metals, such as Cu, Ni, embedded in and dispersed throughout the glass layer.

To make a resistor with the material of the present invention, the resistance material is applied in a uniform-drying thickness of 20–25$\mu$ on the surface of the ceramic body which has been fired with the termination as described earlier. Compositions can be printed either by using an automatic printer or a hand printer in the conventional manner. Preferably the automatic screen printed techniques are employed using a 200–325 mesh screen. The printed pattern is then dried at below 200° C., e.g. to about 150° C. for about 5–15 minutes before firing. Firing to effect sintering of the materials and to form a composite film is preferably done in a belt furnace with a temperature profile that will allow burnout of the organic matter at about 300°–600° C., a period of maximum temperature of about 800°–1000° C. lasting about 5–30 minutes, followed by a controlled cooldown cycle to prevent unwanted chemical reactions at intermediate temperatures or substrate fracture of stress development within the film which can occur from too rapid cooldown. The overall firing procedure will preferably extend over a period of about 1 hour with 20–25 minutes to reach the firing temperature, about 10 minutes at the firing temperature, and about 20–25 minutes in cooldown. The furnace atmosphere is kept low in oxygen partial pressure by providing a continuous flow of $N_2$ gas through the furnace muffle. A positive pressure of gas must be maintained throughout to avoid atmospheric air flow into the furnace and thus an increase of oxygen partial pressure. As a normal practice, the furnace is kept at 800° C. and $N_2$ or similar inert gas flow is always maintained. The above-described pretermination of the resistor system can be replaced by post termination, if necessary. In the case of post termination, the resistors are printed and fired before terminating.

TEST PROCEDURES

In the Examples below, hot temperature coefficient of resistance (HTCR) is measured in the following manner:

Samples to be tested for Temperature Coefficient of Resistance (TCR) are prepared as follows:

A pattern of the resistor formulation to be tested is screen printed upon each of ten coded Alsimag 614 1×1" ceramic substrates and allowed to equilibrate at room temperature and then dried at 150° C. The mean thickness of each set of dried films before firing must be 20–25 microns as measured by a Brush Surfanalyzer. The dried and printed substrate is then fired for about 60 minutes using a cycle of heating at 35° C. per minute to 850° C., dwell at 850° C. for 9 to 10 minutes and cooled at a rate of 30° C. per minute to ambient temperature.

RESISTANCE MEASUREMENT AND CALCULATIONS

The test substrates are mounted on terminal posts within a controlled temperature chamber and electrically connected to a digital ohm-meter. The temperature in the chamber is adjusted to 25° C. and allowed to equilibrate, after which the resistance of each substrate is measured and recorded.

The temperature of the chamber is then raised to 125° C. and allowed to equilibrate, after which the resistance of the substrate is again measured and recorded.

The hot temperature coefficient of resistance (TCR) is calculated as follows:

$$\text{Hot } TCR = \frac{R_{125^\circ C.} - R_{25^\circ C.}}{R_{25^\circ C.}} \times (10{,}000) \text{ ppm/°C.}$$

The values of $R_{25^\circ}$ C. and Hot TCR (HTCR) are averaged and $R_{25^\circ}$ C. values are normalized to 25 microns dry printed thickness and resistivity is reported as ohms per square at 25 microns dry print thickness. Normalization of the multiple test values is calculated with the following relationship:

$$\text{Normalized Resistance} = \frac{\text{Avg. measured resistance} \times \text{Avg. dry print thickness, microns}}{25 \text{ microns}}$$

COEFFICIENT OF VARIANCE

The coefficient of variance (CV) is a function of the average and individual resistances for the resistors tested and is represented by the relationship $\sigma/R_{av}$, wherein $$\sigma = \sqrt{\frac{\Sigma_i(R_i - R_{av})^2}{n-1}}$$

$R_i$=measured resistance of individual sample.

$R_{av}$=calculated average resistance of all samples ($\Sigma_i R_i/n$)

n=number of samples $CV=\sigma/R\times 100$ (%)

The invention will be better understood by reference to the following examples in which all compositions are given in percentages by weight unless otherwise noted.

EXAMPLES

In the Examples which follow, the following glass compositions were used:

TABLE 1

| GLASS FRIT COMPOSITIONS | | | |
|---|---|---|---|
| Component | A | B | C |
| CaO | 4.0% wt. | — | 10.8 |
| ZnO | 27.6 | — | — |
| $SiO_2$ | 21.7 | 3.5 | 29.9 |
| $B_2O_3$ | 26.7 | 3.5 | 33.5 |
| $Na_2O$ | 8.7 | — | — |
| $Al_2O_3$ | 5.7 | — | 21.1 |
| $ZrO_2$ | 4.0 | — | |
| BaO | 0.9 | | |
| PbO | 0.7 | 11.0 | |
| $Bi_2O_3$ | — | 82.0 | — |
| $CaTiO_3$ | — | — | 0.8 |
| $CaZrO_3$ | — | — | 3.9 |

EXAMPLES 1–4

Solid solutions of $SnO_2$:Sb containing $MoSi_2$ as a TCR driver were ball milled in water for 22 hours (24 hours for Examples 2–4) and dried overnight at 125° C. The dry material was then dry milled for 15 minutes to yield a homogeneous fine powder. Resistor compositions were formulated and resistors were made therefrom and tested. The composition of the formulation and the electrical properties of the resistors therefrom are given in Table 2 below.

TABLE 2

| ELECTRICAL PROPERTIES OF $SnO_2$:Sb RESISTORS | | | | |
|---|---|---|---|---|
| EXAMPLE NO. | 1 | 2 | 3 | 4 |
| | % wt. | | | |
| Composition | | | | |
| Processed Powder(1) | 39.6 | 50.0 | 48.0 | 45.0 |
| $RuO_2$ | 3.0 | 4.0 | 4.0 | 4.0 |
| Glass A | 28.4 | 16.0 | 18.0 | 21.0 |
| Organic Medium | 29.0 | 30.0 | 30.0 | 30.0 |
| Resistor Properties | | | | |
| $R_{av}$ (Ω/□) | 19 | 250 | 282 | 625 |
| HTCR (ppm/°C.) | 15 | 373 | 282 | −25 |

(1)$SnO_2$:Sb (94:6) 30.3% wt.
Glass A 47.0% wt.
$MoSi_2$ 22.7% wt.

These data show that by the use of added conductive material ($RuO_2$) and a TCR driver ($MoSi_2$), the resistors can be made have quite low resistivities and practicable HTCR values.

EXAMPLE 5

A quantity of Processed Powder identical to the one used in Examples 1–4 was used to formulate a resistor composition in the manner described above and resistors where made therefrom and tested. The composition of the formulation and the electrical properties of the resistors therefrom are given below.

| | |
|---|---|
| Composition | |
| Processed Powder (1) | 59.4% wt. |
| $RuO_2$ | 4.5 |
| Glass C | 7.1 |
| Organic Medium | 29.0 |
| Resistor Properties | |
| $R_{av}$ (Ω/□) | 6.5 |
| HTCR (ppm/°C.) | +1150 |

The resistors prepared from the above compositions had quite low resistivity and high positive HTCR values. These properties can easily be adjusted by revising the proportions of the semiconductive, conductive and insulating components. For example, the resistance can be raised and the HTCR reduced by (1) adding more Processed Powder to the composition and reducing the amount of $RuO_2$, or (2) increasing the amount of glass and reducing the amounts of $RuO_2$ and Processed Powder.

EXAMPLES 6 AND 7

Again using a quantity of Processed Powder prepared in the manner of the previous examples, two additional thick film resistor compositions were formulated and resistors were made therefrom and tested. The compositions of each of the formulations and the electrical properties of the resistors therefrom are given in Table 3 below:

TABLE 3

HIGH RESISTIVITY, LOW HTCR RESISTORS

| Example No. | 6 | 7 |
|---|---|---|
| | (% wt.) | |
| Composition | | |
| Processed Powder (1) | 30.0 | 33.6 |
| $Pb_5Ge_3O_{11}$ Glass | 28.0 | 28.4 |
| Chi-Alumina | 6.0 | 6.0 |
| $MoSi_2$ | 11.0 | — |
| Organic Medium | 25.0 | 32.0 |
| Resistor Properties | | |
| $R_{av}$ (Ω/□) | $1.1 \times 10^6$ | $9.8 \times 10^6$ |
| HTCR (ppm/°C.) | −5,400 | −4,300 |

The above-described resistors have extremely high resistivities and highly negative HTCR values. These properties can, however, be adjusted by simple compositional changes. For example, the resistivity can be lowered by the addition of one or more conductive phase materials and the HTCR can be made less negative by the addition of TCR drivers such as $Nb_2O_5$, $TaSi_2$, $NiSi_2$ and mixtures thereof. Similar results can be obtained by reducing the amount of chi-alumina and adding $MoSi_2$ to the composition.

I claim:

1. A thick film resistor composition for firing in a low oxygen-containing atmosphere comprising finely divided particles of (a) a semiconductive material consisting essentially of a cationic excess solid solution in metal oxide, of a metal (1) the oxide of which has a lower oxygen partial pressure at the firing temperature than the oxygen partial pressure of the atmosphere in which the composition is fired and (2) which has a free energy of formation more negative than copper; and (b) a nonreducing glass having a softening point below that of the semiconductive material, both dispersed in (c) organic medium.

2. The composition of claim 1 in which the semiconductive material is selected from $Sn:SnO_2$, $Sb:SnO_2$, $In:SnO_2$, $Zr:ZrO_2$, $Hf:HfO_2$ and $Zr:HfO_2$.

3. The composition of claim 1 in which the nonreducing glass is selected from alumino borosilicate glass containing $Ba^{2+}$, $Ca^{2+}$, $Zn^{2+}$, $Na^{+}$ and $Zr^{4+}$, alumino borosilicate glass containing $Pb^{2+}$ and $Bi^{3+}$, and alumino borosilicate glass containing $Ca^{2+}$, $Zr^{4+}$ and $Ti^{4+}$, lead germanate glass and mixtures thereof.

4. The composition of claim 1 which contains particles of a conductive material selected from $RuO_2$, Ru, Cu, Ni, $Ni_3B$ and mixtures and precursors thereof.

5. A resistor element comprising a printed layer of thick film composition comprising finely divided particles of (a) a semiconductive material consisting essentially of a cationic excess solid solution in metal oxide of a metal (1) the oxide of which has a lower oxygen partial pressure at the firing temperature than the oxygen partial pressure of the atmosphere in which the composition is fired and (2) which has a free energy of formation more negative than copper; and (b) a nonreducing glass having a softening point below that of the semiconductive material, both dispersed in (c) organic medium, which composition has been fired in a low oxygen-containing atmosphere to effect volatilization of the organic medium therefrom and liquid phase sintering of the glass.

6. A method for making a resistor element comprising the sequential steps of (1) applying a patterned thick film layer of the composition of claim 1 to a ceramic substrate; and (2) firing the composition in a low oxygen-containing atmosphere to effect volatilization of the organic medium therefrom and liquid phase sintering of the non-reducing glass.

7. A resistor element which has been fired in a low oxygen-containing atmosphere comprising a thick film layer of finely divided particles of (a) a semiconductive material consisting essentially of a cationic excess solid solution in metal oxide of a metal (1) the oxide of which has a lower oxygen partial pressure at the firing temperature than the oxygen partial pressure of the atmosphere in which the composition is fired and (2) which has a free energy of formation more negative than copper; and (b) a liquid phase-sintered nonreducing glass having a softening point below that of the semiconductive material.

* * * * *